US005991942A

United States Patent [19]

Neal

[11] Patent Number: 5,991,942

[45] Date of Patent: Nov. 30, 1999

[54] DISPOSABLE SINK AND DRAIN PROTECTOR AND RUBBISH COLLECTOR

[76] Inventor: Crystal Neal, 6217 Eagle Ct., Lancaster, Calif. 93536

[21] Appl. No.: 09/102,269

[22] Filed: Jun. 22, 1998

[51] Int. Cl.[6] ..... A47K 1/06

[52] U.S. Cl. ..... 4/655; 4/654

[58] Field of Search ..... 4/655, 659, 580, 4/581, 582, 583, 657

[56] References Cited

U.S. PATENT DOCUMENTS 1,703,053 2/1929 Belles ..... 4/655
1,987,020 1/1935 Looft ..... 4/655
2,147,805 2/1939 Windsor ..... 4/655
2,817,851 12/1957 Barnell ..... 4/655

*Primary Examiner*—David J. Walczak
*Attorney, Agent, or Firm*—Crystal R. Neal

[57] ABSTRACT

A sink and drain protector and rubbish collector for protecting the surface of a sink. The protector includes a plastic rectangular sheet having a perforated slit therein such that a faucet on the sink protrudes through the slit when the protector is placed in the sink basin. Further, the protector extends over an upper surface of the sink and partially covers an outer surface of the sink which depends from the upper surface.

1 Claim, 1 Drawing Sheet

DISPOSABLE SINK AND DRAIN PROTECTOR AND RUBBISH COLLECTOR

BACKGROUND OF THE INVENTION

Sink drains are often clogged with debris that falls into the sink and the sink basin surface is often marred by such debris. Further, valuables such as jewelry often fall into the drain and are difficult to retrieve. Accordingly, there is a need for a sink and drain protector which would enable the sink to be used without debris or valuables falling in the drain and which would also protect the surface of the sink basin.

BRIEF SUMMARY OF THE INVENTION

My present invention solves the problem of debris clogging a sink drain and valuables falling into the sink drain and also protects the surface of the sink. The sink and drain protector and rubbish collector that I have developed can be readily placed over all presently known sink and faucet structures without the use of tools or outside fastening elements. This protector is made from polyethylene plastic and can be used to remove waste which falls into the sink by simply gathering edges of the protector and tying them off with a tie.

The sink and drain protector and rubbish collector comprises a single sheet of plastic which can conform to the inner surface of the sink by smoothing the protector over the sink surface. Further, the protector includes a perforated slit which can be torn open in order to enable the water faucet and water faucet hot and cold control handles to protrude through the protector and thereby enable the faucet to be accessible and useable to a user when the protector is in place over the sink. The protector also extends over the top edges of the sink and over at least a portion of the outer edge surfaces of the sink in order to further protect the sink.

These and other features of the present invention may be more fully appreciated when considered in light of the following specification and drawings.

DESCRIPTION OF THE PREFERRED EMBODIMENT

Figure 1:
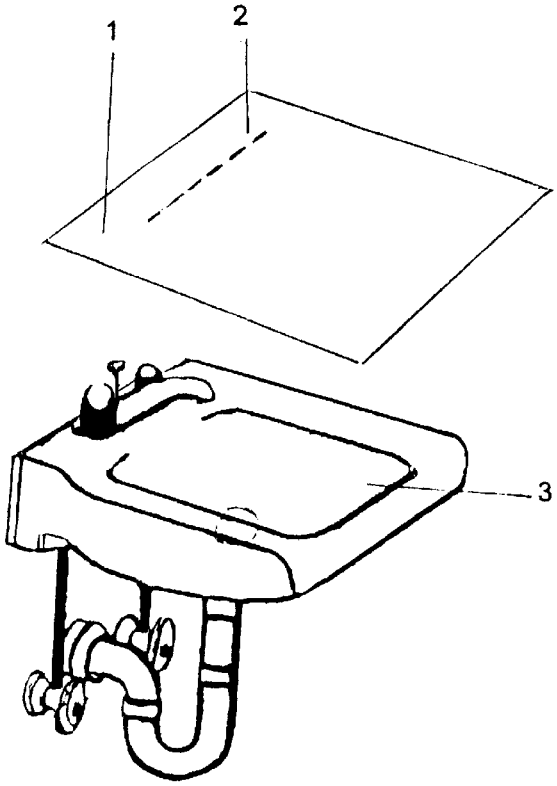
FIG. 1 shows a perspective view of the present invention with certain aspects there of shown in phantom.
Figure 3:
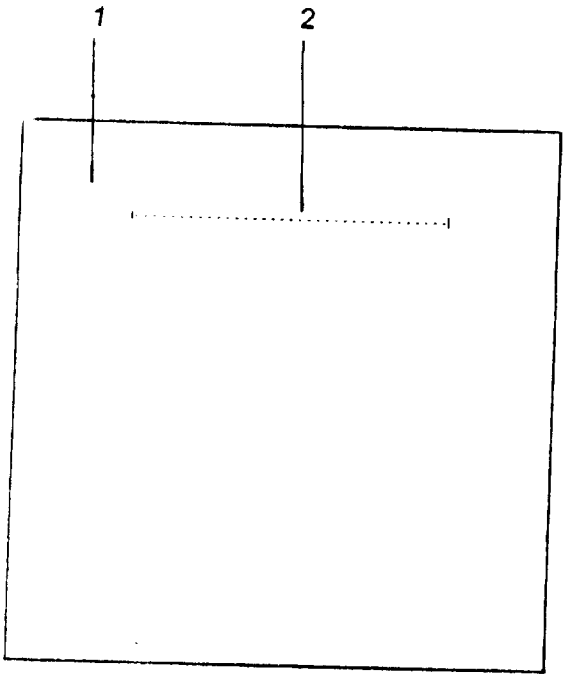
FIG. 3 is a plan view of the disposable sink and drain protector.
Figure 2:
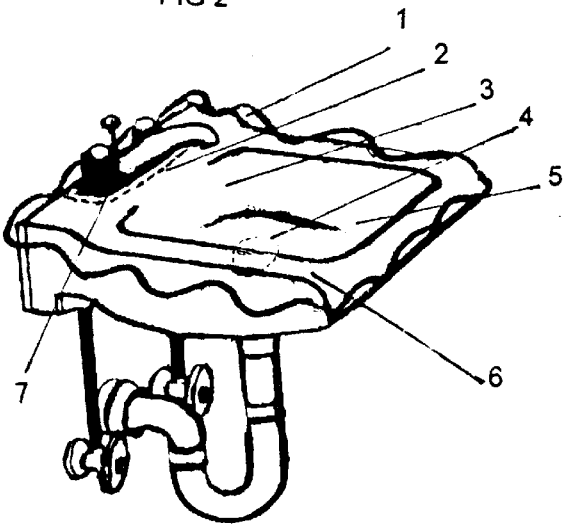
FIG. 2 is a plan view of an sink and drain protector protecting the sink.

Referring now to the figures, and in particular FIG. 2, there is shown a sink 5 having a basin 3 therein, a drain 4 in the bottom of the basin, an upper, substantially horizontal surface 6 surrounding the basin, an outer surface 8 depending from the upper surface and a water faucet and hot and cold water faucet control knob assembly 7. The sink and drain protector and rubbish collector 1 of the present invention, as best seen in FIGS. 1 and 3, is made from a square or rectangular sheet of flexible polyethylene plastic material and includes a perforated slit 2 positioned approximately three inches from an edge of the sheet.

In use, the perforated slit 2 of the protector 1 is torn open to form an aperture in the protector and the protector is placed within the sink basin 3 while the faucet assembly 7 protrudes through the aperture. The protector 1 is then smoothed to conform to the inner surface of the sink to thereby cover the drain such that water and other debris entering the sink basin cannot pass into the drain and protect the sink surface. Further, outer edges of the protector extend over the upper surface 6 and partially cover the outer surface 8 to further protect the sink.

Figure 4:
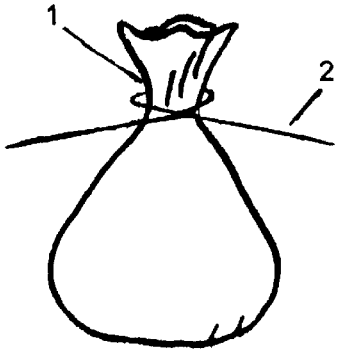
FIG. 4 is a plan view of the disposable sink and drain protector being form into a sac and tied.

If desired, debris which has collected in the sink basin and over the protector can be collected by gathering edges of the protector and tying them off with a tie 9, as shown in FIG. 4.

I claim:

1. A sink and drain protector and rubbish collector for use with a sink wherein the sink is defined by an inner basin with a drain therein, an upper substantially horizontal surface surrounding the basin, an outer side surface depending from the upper surface and a water faucet and hot and cold water faucet control knob assembly positioned on the upper surface of the sink wherein the sink and drain protector and rubbish collector comprises:

a substantially rectangular sheet of flexible plastic material having a perforated slit positioned approximately three inches from an edge of said sheet wherein when said perforated slit is torn open to form an aperture in said sheet wherein when said sheet is positioned on the sink to protect the sink, said sheet conforms to the contour of the inner basin and thereby covers the drain such that water and other debris entering the sink basin cannot pass into the drain while the water faucet and hot and cold water faucet control knob assembly protrudes through said aperture formed by said perforated slit such that the water faucet and hot and cold water faucet control knob assembly is accessible and usable to a user and wherein edges of said sheet extend over the upper surface of the sink and extend downward to at least partially cover the outer side surface of the sink.

* * * * *